US010787287B2

(12) United States Patent
Usami et al.

(10) Patent No.: US 10,787,287 B2
(45) Date of Patent: Sep. 29, 2020

(54) SYNTHETIC RESIN CONTAINER

(71) Applicants: Tetsuro Usami, Tokyo (JP); Takayuki Kobayashi, Tokyo (JP); Hiroaki Imai, Tokyo (JP)

(72) Inventors: Tetsuro Usami, Tokyo (JP); Takayuki Kobayashi, Tokyo (JP); Hiroaki Imai, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 13 days.

(21) Appl. No.: 15/570,716

(22) PCT Filed: Apr. 8, 2016

(86) PCT No.: PCT/JP2016/001960
§ 371 (c)(1),
(2) Date: Oct. 30, 2017

(87) PCT Pub. No.: WO2016/174831
PCT Pub. Date: Nov. 3, 2016

(65) Prior Publication Data

US 2018/0093789 A1 Apr. 5, 2018

(30) Foreign Application Priority Data

Apr. 30, 2015 (JP) ..... 2015-093431

(51) Int. Cl.
*B65D 1/02* (2006.01)
*B65D 79/00* (2006.01)
*B65D 1/42* (2006.01)

(52) U.S. Cl.
CPC ..... *B65D 1/0223* (2013.01); *B65D 1/0207* (2013.01); *B65D 1/42* (2013.01);
(Continued)

(58) Field of Classification Search
CPC ..... B65D 1/0223; B65D 1/0207; B65D 2501/0036; B65D 1/42; B65D 79/005;
(Continued)

(56) References Cited

U.S. PATENT DOCUMENTS 5,704,504 A 1/1998 Bueno
5,848,516 A * 12/1998 Ban ..... B65D 1/0223 53/453
(Continued)

FOREIGN PATENT DOCUMENTS

BR 9303188 A * 4/1995 ..... B65D 1/02
CA 2418367 A1 2/2002
(Continued)

OTHER PUBLICATIONS

Oct. 18, 2018 Office Action issued in Chinese Patent Application No. 201680025790.6.
(Continued)

*Primary Examiner* — Robert J Hicks
(74) *Attorney, Agent, or Firm* — Oliff PLC

(57) ABSTRACT

A synthetic resin container that effectively absorbs reduced pressure generated inside the container due to hot filling to maintain the appearance and shape. A synthetic resin container includes a mouth as a dispensing spout for a content medium, a trunk, extending contiguous to the mouth via a shoulder, and a bottom, closing a lower end of the trunk. The trunk is provided with reduced pressure absorbing panels, which are formed as ribs extending in the vertical direction while twisting in the circumferential direction about a central axis of the trunk and which are arranged side by side in the circumferential direction of the trunk. Twist angle of a lower end with respect to an upper end of each reduced pressure absorbing panel about the central axis is 50 degrees or more.

2 Claims, 3 Drawing Sheets

(52) U.S. Cl.
CPC .... *B65D 79/005* (2013.01); *B65D 2501/0018* (2013.01); *B65D 2501/0027* (2013.01); *B65D 2501/0036* (2013.01)

(58) Field of Classification Search
CPC .... B65D 2501/0018; B65D 2501/0027; B65D 1/44; B65D 1/02; B65D 11/24; B65D 11/22
USPC ..... 220/675, 669, 673, 670; 215/383, 382, 215/381
See application file for complete search history.

(56) References Cited

U.S. PATENT DOCUMENTS

| | | | | |
|---|---|---|---|---|
| 6,616,001 | B2 * | 9/2003 | Saito | B65D 1/0223 215/381 |
| 8,556,097 | B2 * | 10/2013 | Mast | B65D 1/0223 215/384 |
| 2001/0030167 | A1 * | 10/2001 | Mooney | B65D 23/102 215/384 |
| 2006/0054587 | A1 * | 3/2006 | Oguchi | B65D 1/0223 215/381 |
| 2006/0283832 | A1 * | 12/2006 | De Cleir | B65D 1/44 215/383 |
| 2008/0050478 | A1 * | 2/2008 | Kinmont | B65D 1/42 426/106 |
| 2009/0321384 | A1 * | 12/2009 | Zhang | B65D 79/005 215/383 |
| 2010/0032405 | A1 * | 2/2010 | Ozawa | B65D 79/005 215/383 |
| 2010/0089865 | A1 | 4/2010 | Oguchi et al. | |
| 2013/0153531 | A1 * | 6/2013 | Schlies | B65D 1/0223 215/381 |

FOREIGN PATENT DOCUMENTS

| | | | | | |
|---|---|---|---|---|---|
| CA | 2609442 | A1 | | 12/2006 | |
| CN | 101005990 | A | | 7/2007 | |
| JP | H06-336239 | A | | 12/1994 | |
| JP | H08-506310 | A | | 7/1996 | |
| JP | 2000-142654 | A | | 5/2000 | |
| JP | 2004-323100 | A | | 11/2004 | |
| JP | 2006-335357 | A | | 12/2006 | |
| JP | 2006-335383 | A | | 12/2006 | |
| JP | 2006335383 | A | * | 12/2006 | B65D 1/02 |
| JP | 2008-174293 | A | | 7/2008 | |
| JP | 2009-057085 | A | | 3/2009 | |
| JP | 2009057085 | A | * | 3/2009 | B65D 1/02 |
| JP | 2010-247834 | A | | 11/2010 | |
| JP | 2014-073849 | A | | 4/2014 | |
| WO | 2010/040081 | A1 | | 4/2010 | |

OTHER PUBLICATIONS

Nov. 19, 2018 Extended Search Report issued in European Patent Application No. 16786111.1.
Dec. 18, 2018 Office Action issued in Japanese Patent Application No. 2015-093431.
Jun. 28, 2016 International Search Report issued in International Patent Application No. PCT/JP2016/001960.
Jul. 30, 2018 Office Action issued in Canadian Patent Application No. 2,984,447.
Oct. 31, 2017 International Preliminary Report on Patentability issued in International Patent Application No. PCT/JP2016/001960.
May 7, 2019 Office Action issued in Chinese Patent Application No. 201680025790.6.
Sep. 16, 2019 Office Action issued in Chinese Patent Application No. 201680025790.6.
Sep. 20, 2019 Office Action issued in European Patent Application No. 16786111.1.
Aug. 6, 2019 Office Action issued in Japanese Patent Application No. 2015-093431.

* cited by examiner

A-A section

SYNTHETIC RESIN CONTAINER

CROSS-REFERENCE TO RELATED APPLICATION

The present disclosure claims priority to and the benefit of Japanese Patent Application No. 2015-93431 filed on Apr. 30, 2015, the entire contents of which are incorporated herein by reference.

TECHNICAL FIELD

The present disclosure relates to a bottle-shaped synthetic resin container including a mouth serving as a dispensing spout for a content medium, a trunk extending contiguous to the mouth via a shoulder, and a bottom closing a lower end of the trunk. The present disclosure especially relates to a synthetic resin container including the trunk provided with reduced pressure absorbing panels.

BACKGROUND

Due to their lightweightness and handleability, excellent stability for preservation of the content media, and inexpensive cost, synthetic resin containers, typical examples of which are oriented polypropylene (OPP) bottles and polyethylene terephthalate (PET) bottles, are used in various applications, such as beverages, foods, and cosmetics.

Such a synthetic resin container is known to include the trunk provided with reduced pressure absorbing panels to cope with so-called hot filling, in which the content medium, such as a beverage, including a juice beverage and tea, and a seasoning, including soy sauce, vinegar, and dressing, is filled at a high-temperature heated state. After the content medium is hot-filled, the mouth is closed with a cap. Then, as the content medium is cooled, the inside of the container is placed under reduced pressure, possibly causing the trunk to be deformed significantly. To address the above problem, the trunk is provided with the reduced pressure absorbing panels, which may be deformed to absorb the reduced pressure inside the container, thereby preventing significant deformation of the entire trunk.

For example, Patent Literature 1 describes a synthetic resin container including a trunk provided with reduced pressure absorbing walls extending in the vertical direction. The described synthetic resin container prevents deterioration in rigidity otherwise caused by a reduction in thickness of the container. Furthermore, with the reduced pressure absorbing panels that may be deformed to absorb the reduced pressure inside the container, the described synthetic resin container also maintains its appearance and shape even in a situation where the container is hot-filled with the content medium.

CITATION LIST

Patent Literature

PTL 1: Japanese Patent Application Publication No. 2004-323100

SUMMARY

Technical Problem

However, even in the existing synthetic resin container described above, once reduced pressure due to hot filling reaches a certain level, the deformation of panel portions cannot absorb the reduced pressure anymore. As a result, a horizontal section of the trunk provided with the reduced pressure absorbing panels is deformed from a circular to a triangular shape, leading to the problem that the appearance and shape of the container cannot be maintained in a favorable state.

The present disclosure has been conceived in light of the above problem, and the present disclosure is to provide a synthetic resin container that effectively absorbs reduced pressure generated inside the container due to hot filling to maintain the appearance and shape of the trunk more stably.

Solution to Problem

One of aspects of the present disclosure resides in a synthetic resin container including a mouth as a dispensing spout for a content medium, a trunk extending contiguous to the mouth via a shoulder, and a bottom closing a lower end of the trunk. The trunk is provided with a plurality of reduced pressure absorbing panels that is formed as a plurality of ribs extending in a vertical direction while twisting in a circumferential direction about a central axis of the trunk and that is arranged side by side in the circumferential direction of the trunk. An angle of the twist of a lower end with respect to an upper end of each of the reduced pressure absorbing panels about the central axis is 50 degrees or more.

In a preferred embodiment of the synthetic resin container configured as above, the angle of the twist is at least 50 degrees and less than 100 degrees.

In another preferred embodiment of the synthetic resin container configured as above, the trunk is defined by a pair of annular horizontal grooves extending in the circumferential direction.

In yet another preferred embodiment of the synthetic resin container configured as above, the reduced pressure absorbing panels each have a width of at least 7 mm and not more than 10 mm in the circumferential direction of the trunk.

In yet another preferred embodiment of the synthetic resin container configured as above, the reduced pressure absorbing panels each have a depth of at least 2 mm and not more than 3 mm in a radial direction of the trunk.

Advantageous Effect

According to the present disclosure, even in a situation where the pressure inside the container is decreased when the content medium at a high temperature is cooled after being filled into the container, the capacity of the container is reduced by twisting movement of the reduced pressure absorbing panels, and accordingly, the appearance and shape of the container are maintained.

DETAILED DESCRIPTION

The present disclosure will be described in more detail below by illustration with reference to the drawings.

Figure 1:
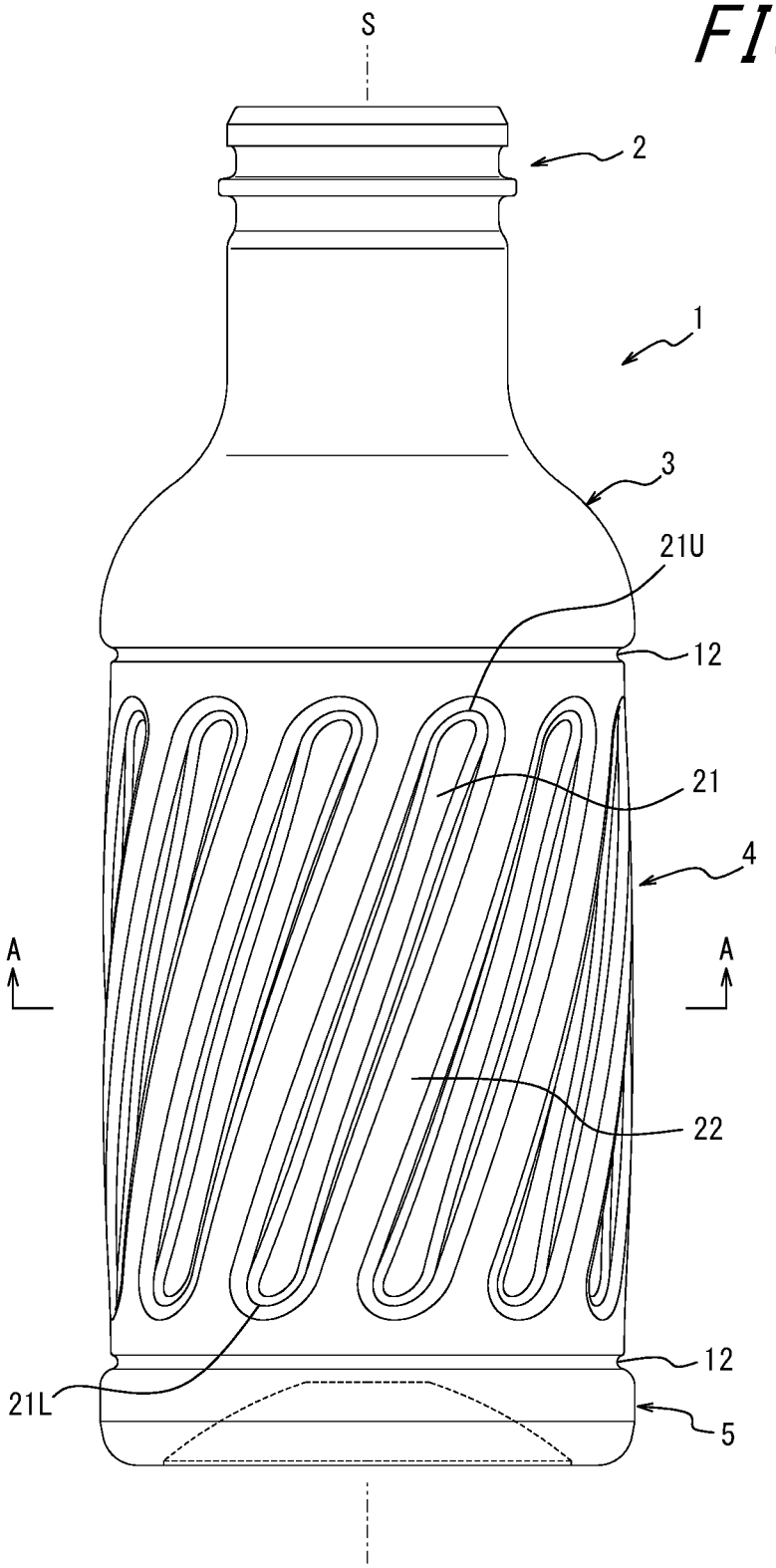
FIG. 1 is a front view illustrating a synthetic resin container according to one of embodiments of the present disclosure.

As illustrated in FIG. 1, a synthetic resin container 1 according to one of embodiments of the present disclosure contains, for example, a beverage, including a juice beverage and tea, and a seasoning, including soy sauce, vinegar, and dressing, as the content medium. The synthetic resin container 1 may cope with hot filling, in which the content medium is filled in a high temperature state where the content medium has been heated to a predetermined temperature. Additionally, the vertical direction of the synthetic resin container 1 refers to the upper and lower direction in FIG. 1.

The synthetic resin container 1 is formed in a bottle shape, which includes a mouth 2 as a dispensing spout for the content medium, a shoulder 3, which has a head-cut conical cylinder shape extending contiguous to a lower end of the mouth 2, a trunk 4, which has a substantially cylindrical shape extending contiguous to the mouth 2 via the shoulder 3, and a bottom 5, which closes a lower end of the trunk 4. Reference numeral S in FIG. 1 denotes the central axis common to the mouth 2, the shoulder 3, the trunk 4, and the bottom 5.

The synthetic resin container 1, for example as a so-called PET bottle, may be formed by biaxial stretch blow molding a polyethylene terephthalate preform. The synthetic resin container 1 may also be formed by biaxial stretch blow molding a preform made of any type of thermoplastic synthetic resin, such as oriented polypropylene (OPP), other than polyethylene terephthalate. Furthermore, the method of producing the synthetic resin container 1 is not limited to biaxial stretch blow molding of a preform and may be any of a variety of production methods, such as extrusion blow molding of a resin material.

The mouth 2 has an outer circumferential surface provided with a protrusion. After the content medium is hot-filled, the mouth 2 may be plugged with a cap by undercut fitting, which is not illustrated, to close the mouth 2. Alternatively, a male screw, instead of the protrusion, may be provided on the outer circumferential surface of the mouth 2. In this case, the mouth 2 may be closed by the cap being screw-connected to the male screw.

The trunk 4 has an upper end and a lower end, which are each provided with an annular horizontal groove 12, which extends in the circumferential direction over the entire circumference of the trunk 4. Each horizontal groove 12 is formed in a concave rib shape that is depressed to the inner side of the trunk 4 from an outer circumferential surface of the trunk 4. By the horizontal grooves 12, the trunk 4 is defined with respect to the shoulder 3 and the bottom 5. Providing the horizontal grooves 12 increases rigidity in the radial direction of panel support portions 22, which constitute the trunk 4. This prevents the trunk 4 from being collapsed into an asymmetrical shape with respect to the central axis S even after hot filling, and accordingly, the appearance and shape of the synthetic resin container 1 are maintained stably.

Providing the horizontal grooves 12 also increases rigidity of the shoulder 3, which is defined by the horizontal groove 12 from the trunk 4. Accordingly, the shoulder 3 endures the reduced pressure generated inside the synthetic resin container 1 due to hot filling and is hardly deformed. As a result, wrinkles do not occur even in a situation where a shrink label or the like is applied to the shoulder 3, and the label may be stably applied to the synthetic resin container 1 in an easy-to-see manner. The shrink label is formed in a tubular shape having a larger diameter than a portion (hereinafter, called a label applied portion) of the trunk 4 in which the label is to be applied and made of a heat-shrinking film such as polystyrene (PS) and polyethylene terephthalate (PET). When heated by hot air or the like in the state where the shrink label covers the outer side of the label applied portion, the shrink label shrinks and is adhered to an outer circumferential surface of the label applied portion to be applied.

The trunk 4 is provided with a plurality of reduced pressure absorbing panels 21, each of which extends in the vertical direction while twisting in the circumferential direction about the central axis S of the trunk 4. Due to the twisting in the circumferential direction, the reduced pressure absorbing panels 21 are arranged in a manner such that the longitudinal direction of the reduced pressure absorbing panels 21 is oblique with respect to the vertical direction of the synthetic resin container 1. The reduced pressure absorbing panels 21 are also arranged side by side in the circumferential direction of the trunk 4. Although, in the present embodiment, 12 reduced pressure absorbing panels 21 are provided, the number of the reduced pressure absorbing panels 21 may be determined at will. The reduced pressure absorbing panels 21 are each formed as a rib that is depressed to the inner side of the trunk 4 relative to the outer circumferential surface of the trunk 4. In a portion between any two adjacent reduced pressure absorbing panels 21, there is also formed a panel support portion 22, which is oblique with respect to the vertical direction. Note that, in FIG. 1, reference numeral 21 is assigned only to a single reduced pressure absorbing panel, and reference numeral 22 is assigned only to a single panel support portion for the sake of convenience.

Figure 2:
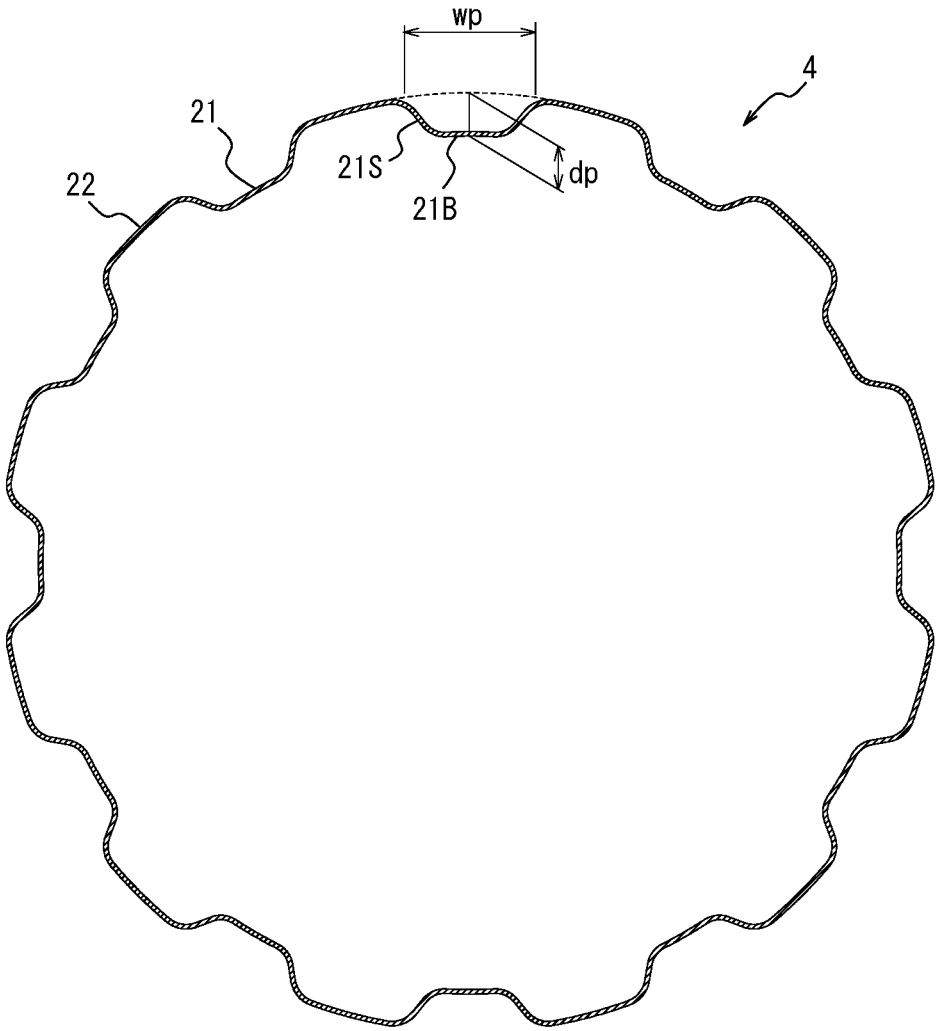
FIG. 2 is a sectional view taken along a line A-A in FIG. 1.

FIG. 2 is a sectional view of the synthetic resin container 1 taken along section A-A in FIG. 1. In FIG. 2, each reduced pressure absorbing panel 21 is configured by panel side surfaces 21S and a panel bottom surface 21B. The reduced pressure absorbing panel 21 has a width wp, which is defined as a distance between a point of intersection between one of the panel side surfaces 21S and one adjacent panel support portion 22 and a point of intersection between the other panel side surface 21S and another adjacent panel support portion 22. The reduced pressure absorbing panel 21 also has a depth dp, which is defined as a distance in the radial direction between an outer surface of the trunk 4 that includes the panel support portions 22 and the panel bottom surface 21B.

The trunk 4 provides the effect of absorbing reduced pressure, by the reduced pressure absorbing panels 21, each of which may be deformed to the inner side in the radial direction, and also by the reduced pressure absorbing panels 21 and the panel support portions 22, which may be deformed through a greater oblique angle. That is to say, the reduced pressure absorbing panels 21 may undergo twisting movement in a manner such that panel lower ends 21L rotate about the central axis S relatively with respect to panel upper ends 21U. The twisting movement of the reduced pressure absorbing panels 21 and the panel support portions 22 reduce the capacity of the synthetic resin container 1. Accordingly, even when the inside of the container is placed under reduced pressure due to hot filling, the reduced pressure absorbing panels 21 and the panel support portions 22 undergo twisting movement, thereby absorbing the reduced pressure.

In this way, the synthetic resin container 1 according to the present embodiment includes the trunk 4, which is provided with the plurality of reduced pressure absorbing panels 21, each of which extends in the vertical direction while twisting in the circumferential direction about the central axis S of the trunk 4. With the above configuration, even though the pressure inside the synthetic resin container 1 is decreased when the content medium at a high temperature is cooled after being filled into the container 1, the capacity of the container is reduced by the twisting movement of the reduced pressure absorbing panels 21, and thus, the reduced pressure is absorbed. Especially when a twist angle of the panel lower end 21L with respect to the panel upper end 21U of each reduced pressure absorbing panel 21 about the central axis S is 50 degrees or more, the effect of absorbing the reduced pressure is enhanced. The result is that significant deformation of the entire trunk 4 is prevented, and the appearance and shape of the synthetic resin container 1 are maintained.

Furthermore, according to the present embodiment, the trunk 4 is defined by the horizontal grooves 12 in the upper end and the lower end of the trunk 4. The above configuration increases rigidity of the panel support portions 22, which constitute the trunk 4, in the radial direction. The result is that the appearance and shape of the synthetic resin container 1 are maintained more stably against hot filling.

Moreover, according to the present embodiment, setting the width wp of each reduced pressure absorbing panel 21 to be at least 7 mm and not more than 10 mm helps retain moldability of the container and maintains the appearance and shape of the container while maintaining predetermined absorbing volume. Setting the depth dp of each reduced pressure absorbing panel 21 to be at least 2 mm and not more than 3 mm also helps retain moldability of the container while maintaining predetermined absorbing volume.

EXAMPLES

Next, to confirm the effect of the present disclosure, synthetic resin containers according to Examples of the present disclosure were subjected to measurement in terms of a relation between twist angle (degrees) of the panel lower ends 21L with respect to panel upper ends 21U of the reduced pressure absorbing panels 21 about the central axis S and absorbing volume (ml). The synthetic resin containers according to the present Examples have the same configuration as the synthetic resin container 1 illustrated in FIG. 1 and are made of polyethylene terephthalate. Two different shapes A and B as illustrated in Table 1 below were used as the shapes of the synthetic resin containers 1 in the present Examples.

TABLE 1

| | Shape A | Shape B |
|---|---|---|
| Shape of trunk 4 | 1 mm convex in middle | Straight |
| Width wp of reduced pressure absorbing panel 21 | 7.70 mm | 8.86 mm |
| Depth dp of reduced pressure absorbing panel 21 | 2.50 mm | 2.50 mm |
| Depth of horizontal groove 12 | 2.00 mm | 2.25 mm |

The shape of the trunk 4 in Table 1 refers to the shape of a contour observed on left and right edges of the trunk 4 in FIG. 1. In FIG. 1, the diameter of the trunk 4 is slightly larger at a middle height of the trunk 4 than in upper and lower ends of the trunk 4 that are in contact with the horizontal grooves 12. The contour observed on the left and right edges of the trunk 4 has a convex shape. As described in Table 1, in the case of shape A, the trunk 4 has a convex shape in which a part of the trunk 4 that is located at the middle height is bulged out 1 mm than portions of the trunk 4 that are located in the upper and lower ends. This means that the diameter of the trunk 4 at the middle height is larger than the diameter of the trunk 4 in the upper and lower ends by 2 mm. On the other hand, in the case of shape B, the contour observed on the left and right edges of the trunk 4 in FIG. 1 is straight, and the diameter of the trunk 4 in the upper and lower ends substantially equals the diameter at the middle height. Furthermore, both the width wp of the reduced pressure absorbing panels 21 and the depth of the horizontal grooves 12 are larger in the case of shape B. Accordingly, in the case of shape B, the reduced pressure absorbing panels 21 are considered to be displaced to a larger extent in response to reduced pressure generated in the synthetic resin container 1. Additionally, the depth dp of the reduced pressure absorbing panels 21 is 2.50 mm in the cases of both shape A and shape B.

Figure 3:
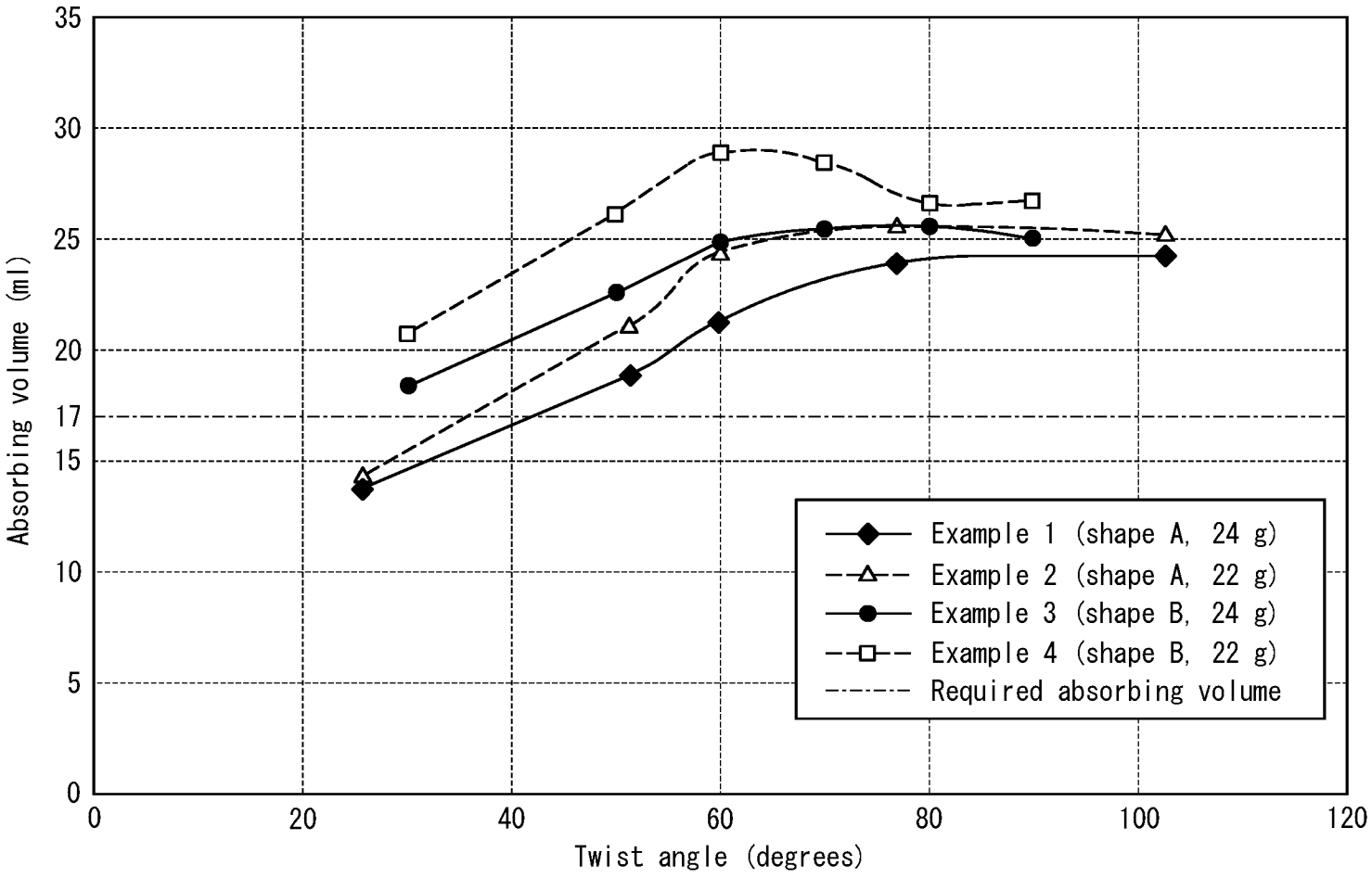
FIG. 3 illustrates a relation between twist angle of reduced pressure absorbing panels and absorbing volume in synthetic resin containers according to Examples of the present disclosure.

In Examples, for each of two shapes A and B described in Table 1, absorbing volume in the case where the weight of the synthetic resin container 1 was 24 g and absorbing volume in the case where the weight of the synthetic resin container 1 was 22 g were quantified. Additionally, in each of the present Examples, the overall height of the synthetic resin container 1 is 155.2 mm, the diameter of the trunk 4 is 60.6 mm, the height of the trunk 4 is 79.2 mm, and the capacity is 300 ml. FIG. 3 depicts measurement results.

When twist angle is 0 degree, the reduced pressure absorbing panels 21 are deformed to the inner side in the radial direction to absorb reduced pressure. As illustrated in FIG. 3, as twist angle is increased, absorbing volume is monotonically increased until twist angle reaches approximately 60 degrees. Even in Example 1 (shape A, container weight 24 g), which has the smallest absorbing volume, an absorbing volume of 17 ml, necessary to maintain the appearance and shape, is achieved at a twist angle of 50 degrees. The reason for this is that, as twist angle is increased, change in length in the vertical direction of the trunk 4 that is caused by the panel lower ends 21L rotating with respect to the panel upper ends 21U of the reduced pressure absorbing panels 21 about the central axis S is increased, and the degree of reduction in capacity is increased. However, in any Example, when twist angle is more than approximately 77 degrees, an increase in absorbing volume is not observed no matter how much twist angle is increased. There is also observed a tendency that moldability is decreased when twist angle is more than 100 degrees.

The greater the width wp of the reduced pressure absorbing panels 21 is, the more absorbing volume tends to be increased. However, when the width wp is more than 10 mm, moldability of the synthetic resin container 1 is deteriorated, thereby making it difficult to maintain the appearance and shape favorably. Accordingly, the width wp of the reduced pressure absorbing panels 21 is preferably at least 7 mm and not more than 10 mm. Furthermore, the greater the depth dp of the reduced pressure absorbing panels 21 is, the more absorbing volume tends to be increased. However, when the depth dp is more than 3 mm, moldability is again deteriorated, thereby making it difficult to maintain the appearance and shape. Accordingly, the depth dp of the reduced pressure absorbing panels 21 is preferably at least 2 mm and not more than 3 mm. Moreover, the less the weight of the synthetic resin container 1 is, the less the buckling strength becomes, although improved pressure absorbing performance is achieved. Accordingly, the weight of the container 1 is preferably 20 g or more. Tables 2 and 3 represent the measurement results of FIG. 3 in numerical values.

TABLE 2

| Twist angle (degrees) | Absorbing volume (ml) of shape A | |
|---|---|---|
| | Example 1 (container weight 24 g) | Example 2 (container weight 22 g) |
| 0.00 | 11.10 | 11.51 |
| 25.7 | 13.80 | 14.40 |
| 51.3 | 18.93 | 21.19 |
| 59.9 | 21.30 | 24.46 |
| 77.0 | 23.98 | 25.63 |
| 102.7 | 24.32 | 25.26 |
| 128.3 | 24.74 | 25.95 |

TABLE 3

| Twist angle (degrees) | Absorbing volume (ml) of shape B | |
|---|---|---|
| | Example 3 (container weight 24 g) | Example 4 (container weight 22 g) |
| 30.0 | 18.45 | 20.75 |
| 50.0 | 22.65 | 26.16 |
| 60.0 | 24.82 | 28.93 |
| 70.0 | 25.49 | 28.52 |
| 80.0 | 25.62 | 26.66 |
| 90.0 | 25.06 | 26.74 |

The present disclosure is not limited to the above embodiment, and various changes may be made without departing the gist of the present disclosure.

For example, the shape, the number, and so forth of the reduced pressure absorbing panels 21 are not limited to the above embodiment, and various modifications may be adopted.

Additionally, the content medium filled into the synthetic resin container 1 is not limited to a beverage, including a juice beverage and tea, and a seasoning, including soy sauce, vinegar, and dressing, and any other content media, such as foods and cosmetics, that may be hot-filled may be used.

REFERENCE SIGNS LIST

1 Synthetic resin container
2 Mouth
3 Shoulder
4 Trunk
5 Bottom
12 Horizontal groove
21 Reduced pressure absorbing panel
21S Panel side surface
21B Panel bottom surface
21U Panel upper end
21L Panel lower end
22 Panel support portion
S Central axis

The invention claimed is:

1. A synthetic resin container that absorbs reduced pressure generated inside of the container due to hot filling so as to maintain an appearance and shape of the container, the container comprising a mouth as a dispensing spout for a content medium, a trunk extending contiguous to the mouth via a shoulder, and a bottom closing a lower end of the trunk, wherein the trunk is provided with a plurality of reduced pressure absorbing panels that is formed as a plurality of ribs extending in a vertical direction while twisting in a circumferential direction about a central axis of the trunk and that is arranged side by side in the circumferential direction of the trunk around an entire circumference of the trunk, an angle of the twist of a lower end with respect to an upper end of each of the reduced pressure absorbing panels about the central axis is 50 degrees or more, the reduced pressure absorbing panels each have a width of at least 7 mm and not more than 10 mm in the circumferential direction of the trunk, and each have a depth of at least 2 mm and not more than 3 mm in a radial direction of the trunk, and the trunk is defined by (a) a first annular groove at an upper end of the trunk, the first annular groove extending around the entire circumference of the trunk and (b) a second annular groove at a lower end of the trunk, the second annular groove extending around the entire circumference of the trunk.

2. The synthetic resin container of claim 1, wherein the angle of the twist is at least 50 degrees and less than 100 degrees.

* * * * *